US007210462B2

(12) United States Patent
Scheffel et al.

(10) Patent No.: US 7,210,462 B2
(45) Date of Patent: May 1, 2007

(54) SUPPORT ELEMENT

(75) Inventors: Martin Scheffel, Vaihingen (DE); Martin Andorfer, Korntal-Muenchingen (DE); Rocco Scholz, Erbach (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 11/090,629

(22) Filed: Mar. 25, 2005

(65) Prior Publication Data

US 2005/0224053 A1 Oct. 13, 2005

(30) Foreign Application Priority Data

Mar. 26, 2004 (DE) ..... 10 2004 015 042

(51) Int. Cl.
*F02M 61/14* (2006.01)
*F02M 61/12* (2006.01)

(52) U.S. Cl. ..... 123/470

(58) Field of Classification Search ..... 123/470, 123/468, 469, 456; 239/600; 292/80
See application file for complete search history.

(56) References Cited

U.S. PATENT DOCUMENTS 4,669,156 A * 6/1987 Guido et al. ..... 24/336
5,772,258 A * 6/1998 Dyer et al. ..... 285/114
5,842,450 A * 12/1998 Fort et al. ..... 123/463
5,893,351 A * 4/1999 Akutagawa et al. ..... 123/470
5,901,688 A * 5/1999 Balsdon et al. ..... 123/516
5,970,953 A * 10/1999 Lorraine et al. ..... 123/470
6,053,149 A * 4/2000 Lorraine ..... 123/470
6,276,339 B1 * 8/2001 Shebert et al. ..... 123/470
6,481,420 B1 * 11/2002 Panasuk et al. ..... 123/470
6,539,920 B1 * 4/2003 Spiers ..... 123/456
6,684,861 B2 * 2/2004 Reiter ..... 123/470
6,748,925 B1 * 6/2004 De Vulpillieres et al. .. 123/470
6,830,037 B1 * 12/2004 Braun et al. ..... 123/470

FOREIGN PATENT DOCUMENTS

| | | |
|---|---|---|
| DE | 29 26 490 | 2/1981 |
| WO | WO 2000/42315 | 7/2000 |
| WO | WO 2004/051074 | 6/2004 |
| WO | WO 2005/059348 | 6/2005 |

* cited by examiner

*Primary Examiner*—Mahmoud Gimie
(74) *Attorney, Agent, or Firm*—Kenyon & Kenyon LLP

(57) ABSTRACT

A support element for the mutual support of a fuel injector in a valve seat, in particular of the valve seat of a cylinder head of an internal combustion engine, and of the fuel injector at a fuel distribution line has a clasp and thereon developed radially and axially deformable clips.

26 Claims, 6 Drawing Sheets

SUPPORT ELEMENT

FIELD OF THE INVENTION

The present invention relates to a support element for setting a fuel distribution line apart from a fuel injector inserted in a cylinder head of an internal combustion engine.

BACKGROUND INFORMATION

A mounting device for mounting a fuel injector on an intake manifold is already known from German Published Patent Application No. 29 26 490, according to which a mounting element axially fixes the fuel injector to the fuel distribution line or to a plug nipple, the mounting element being designed as a U-shaped securing clasp having two legs which are elastic in the radial direction. In the assembled state, the securing clasp engages in matching recesses of the plug nipple and is snapped into place in a recess in a connection piece of the fuel injector, the recess being designed as an annular groove. The axial clearance between the recesses and the securing clasp as well as between the annular groove and the securing clasp should be kept small, in order to achieve accurate fixation of the fuel injector without stresses on the gasket.

Particularly disadvantageous in the mounting device known from German Published Patent Application No. 29 26 490 is the warping effect of the various mounting elements on the fuel injector. The flux of force generated in the fuel injector results in deformations and thus to lift changes of the valve needle and even to jamming as well as a compressive and bending load on the housing components, which usually have thin walls and are welded to one another at several points. Furthermore, any mounting measure, for example by a contact flange, leads to an increase in the radial expansion of the fuel injector and thus to higher space requirements in the installation.

SUMMARY OF THE INVENTION

By contrast, the support element according to the present invention for a fuel injector has the advantage that the support element on account of its form as well as on account of appropriately designed clips provides for a transfer of the holding-down force of the fuel distribution line on the fuel injector that compensates for tolerances and offsets. To this end, the clips and the clasp of the support element are designed to be axially and radially deformable such that a more uniform distribution of force and thereby a high stability and a robustness in continuous operation are ensured while keeping manufacture and installation simple.

It is particularly advantageous that the support element is easy to manufacture by stamping from sheet metal.

Screws or clamping claws for mounting the fuel injector on the front face of the cylinder head are advantageously dispensed with in the support element according to the present invention. Punched out recesses, which are easy to produce, advantageously provide secure fixing of the support element at the fuel injector and simple bracing of the fuel distribution line. The clips are connected by a cross-piece to the clasp of the support element. In another advantageous specific embodiment, the clips are connected to each other by an arch.

The clips or the arch are advantageously deformed by the application of force in such a way that they shift radially towards the outside and project past the outer contour of the clasp. This provides an additional guidance of the support element in the valve seat.

The clasp is also radially and axially flexible, which allows it to compensate for offsets in any direction.

DETAILED DESCRIPTION

Figure 1A:
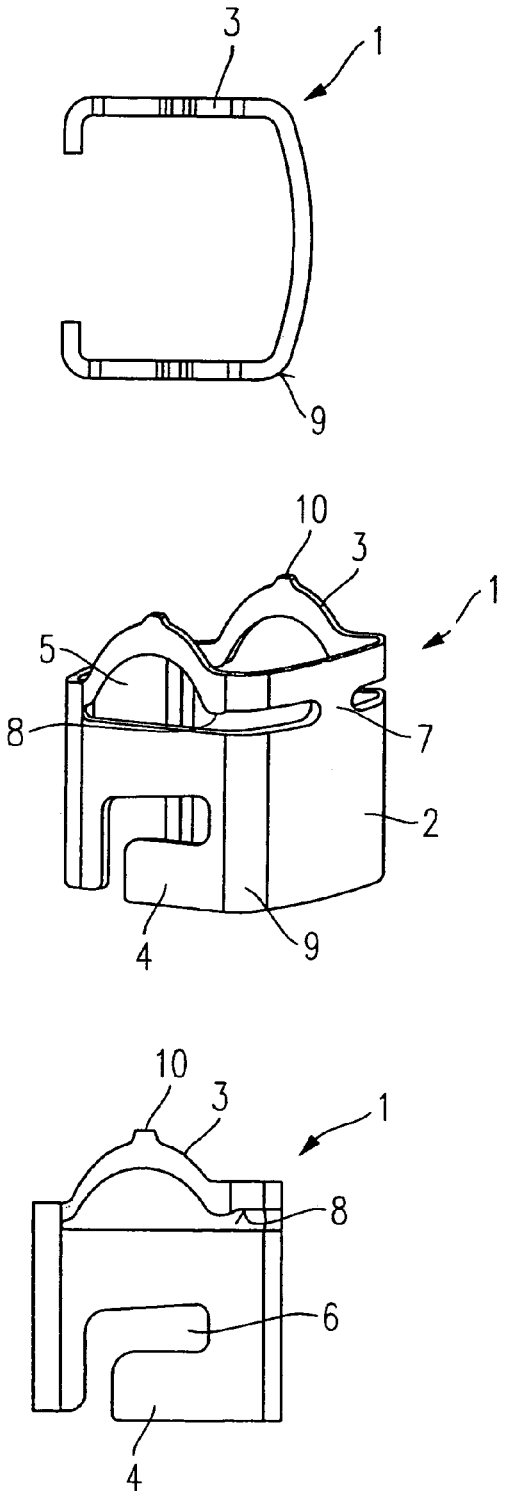
FIGS. 1A–C show a first exemplary embodiment of a support element developed according to the present invention for a fuel injector in various views.

FIGS. 1A through 1C and 2A through 2C show in the same representation various schematic views of two exemplary embodiments of support elements 1 according to the present invention for fixing fuel injectors in position in a cylinder head of an internal combustion engine and for connecting the fuel injectors to a fuel distribution line.

In each case, the upper row of figures shows a top view, the middle row of figures shows a perspective view, and the lower row of figures shows a side view of support elements 1 developed according to the present invention. The left column of figures shows support element 1 in a ready-to-fit, but non-loaded state, while the middle column of figures shows support element 1 in each case in a preloaded state, and the right column of figures shows the support element in an fully installed and loaded state.

Support element 1 includes in each case a clasp 2, which embraces the fuel injector, and clips 3 developed at clasp 2, tabs 4 and legs 17 for flexibly fixing the individual components of the fuel system in position with respect to one another. Support element 1 may in each case be installed in the represented position having tabs 4 abutting against the fuel injector and clips 3 against the fuel distribution line, or it may also be installed turned by 120° having clips 3 contacting the fuel injector and tabs 4 contacting the fuel distribution line.

In the case of conventional support elements 1, clips 3 are the parts carrying the greatest load, which depending on their respective form tend to break off of clasp 2. If this occurs, then the offset-free transmission of force between the fuel distribution line and the fuel injector is no longer guaranteed such that lateral forces can occur and can result in damage to the various components.

To counter this, clips 3 according to the present invention are attached to clasp 2 in such a way that they are deformable in a plastic-elastic manner both in the axial as well as in the radial direction, which on the one hand allows for a reliable fixation while compensating for lateral forces and on the other hand allows for a distribution of the applied force and a relief of the transition regions between clips 3 and clasp 2.

When viewing the middle row of figures of FIGS. 1 and 2, the different load levels of support element 1 are apparent.

Figure 2A:
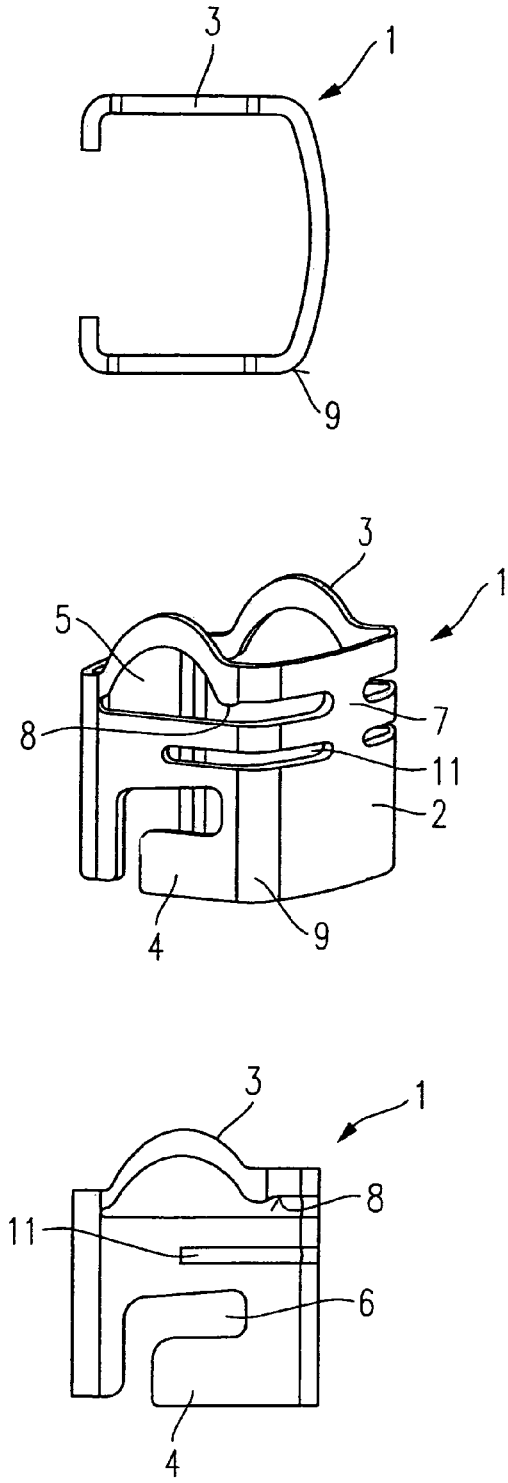
FIGS. 2A–C show a second exemplary embodiment of a support element developed according to the present invention for a fuel injector in various views.

First support element 1 is manufactured by punching, punching out recesses 5 between clasp 2 and clips 3 as well as punching out slots 6 in clasp 2. Clasp 2 is then bent until the shape according to FIG. 1A or 2A is achieved. Support element 1 is still non-loaded.

FIGS. 1 and 2 show that clips 3 are connected to clasp 2 by a crosspiece 7 through a suitable formation of recesses 5. Clips 3 thus have very flexible spring properties.

Figure 1B:
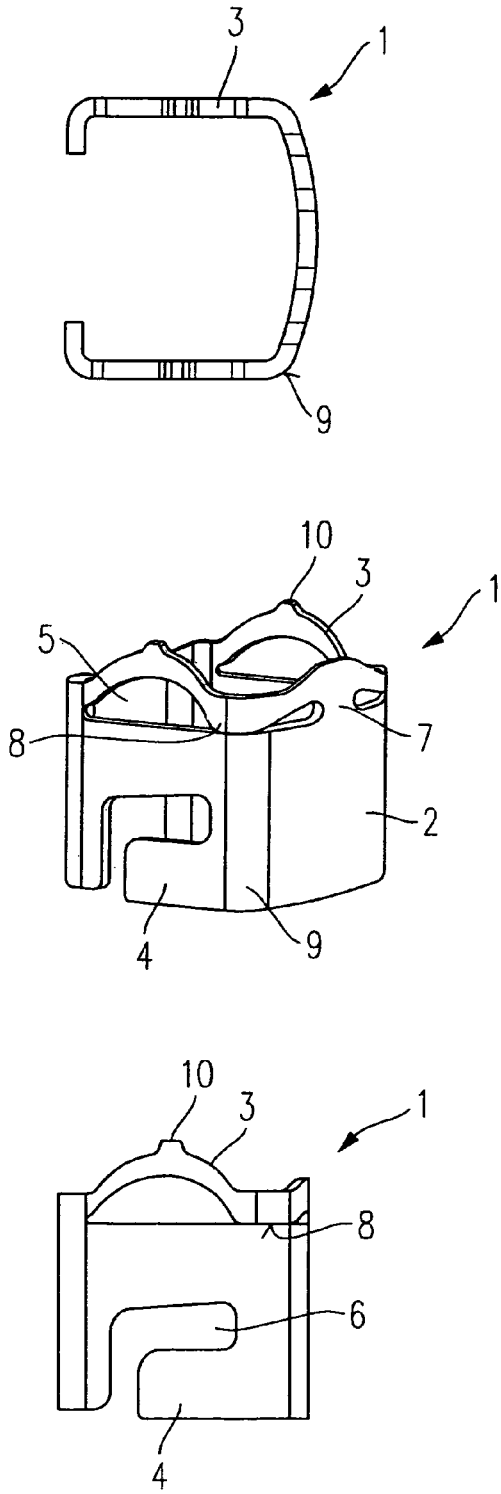
Figures 2B, 2C:
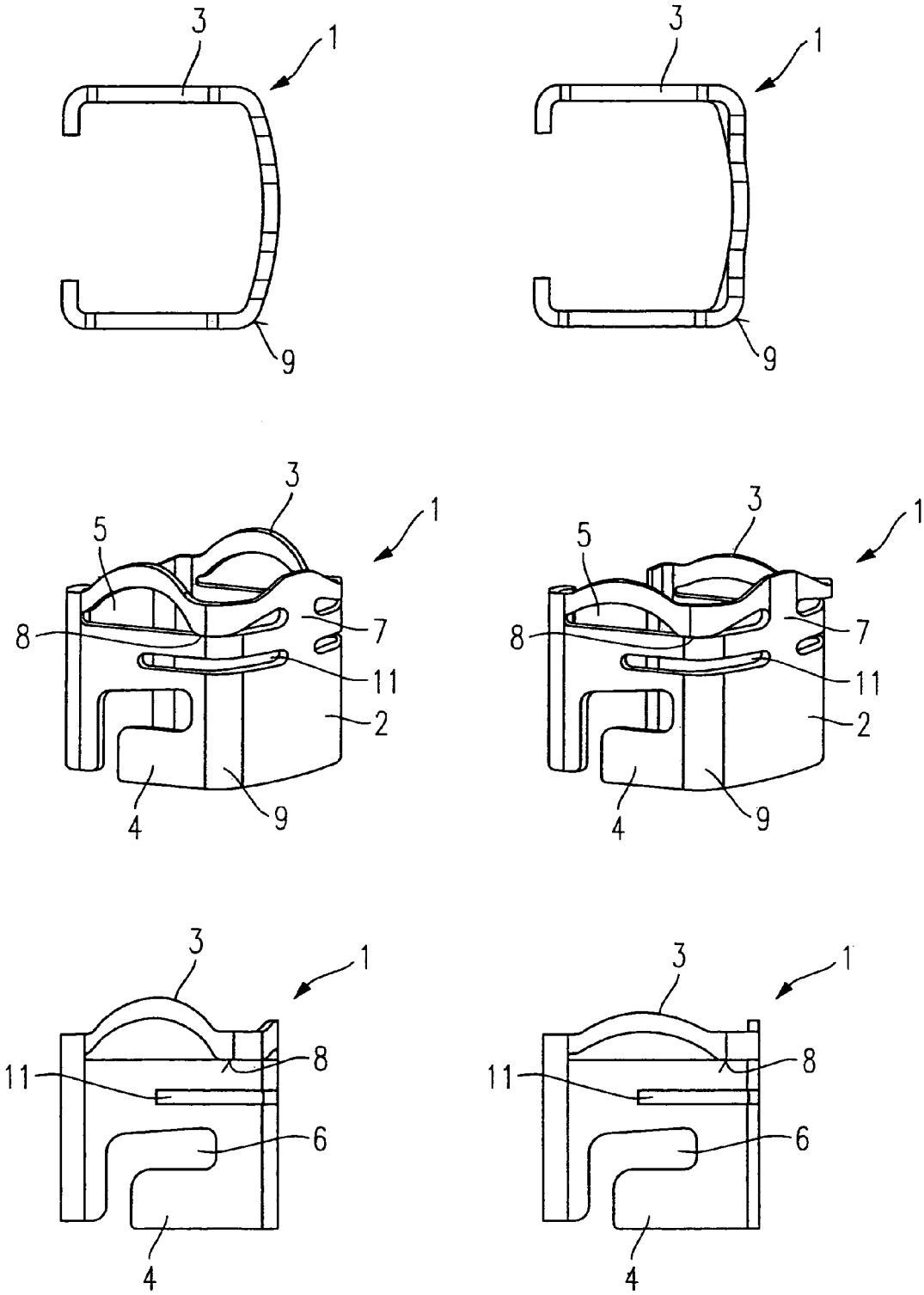

In FIGS. 1B and 2B, support element 1 is deformed in a further step, which brings clips 3 in impact regions 8 at corners 9 of clasp 2 in contact with clasp 2. Support element 1 is now ready for installation.

If support element 1 is now installed between the fuel injector and the fuel distribution line, the fuel distribution line will apply a defined holding-down force on the fuel injector via support element 1. As can be seen from FIGS. 1C and 2C, clips 3 are thereby deformed in the axial direction on the one hand and in the radial direction on the other. The axial deformation in this instance has the effect that a distance between clips 3 and clasp 2 or the width of recesses 5 decreases in comparison to the force-free state. In impact regions 8, where clips 3 abut against clasp 2, clips 3 additionally shift radially towards the outside due to the compressive force of the fuel distribution line. This can be seen in particular also in the upper row of FIGS. 1C and 2C in support elements 1 shown in a top view. The force acting on clips 3 thus has a radial and an axial component, which has the effect that clips 3 bear less load while offering unvarying good support and fixation. This extends the service life of support elements 1. Additionally, guidance is provided for the support element in the valve seat.

FIGS. 1 and 2 additionally contain further design features, which, combinable as desired, may be formed at support elements 1. Thus, the first exemplary embodiment according to FIG. 1 has on clips 3 in each case a projection 10, which decreases the contact surface of clips 3 on the fuel injector on the fuel distribution line, thereby allowing the radial deformation to occur with less friction.

According to the second exemplary embodiment in FIG. 2, clasp 2 may have additional slots 11, which influence the radial and axial elasticity of clasp 2, thereby allowing the spring characteristic to be adapted specifically to the requirements.

Figure 1C:
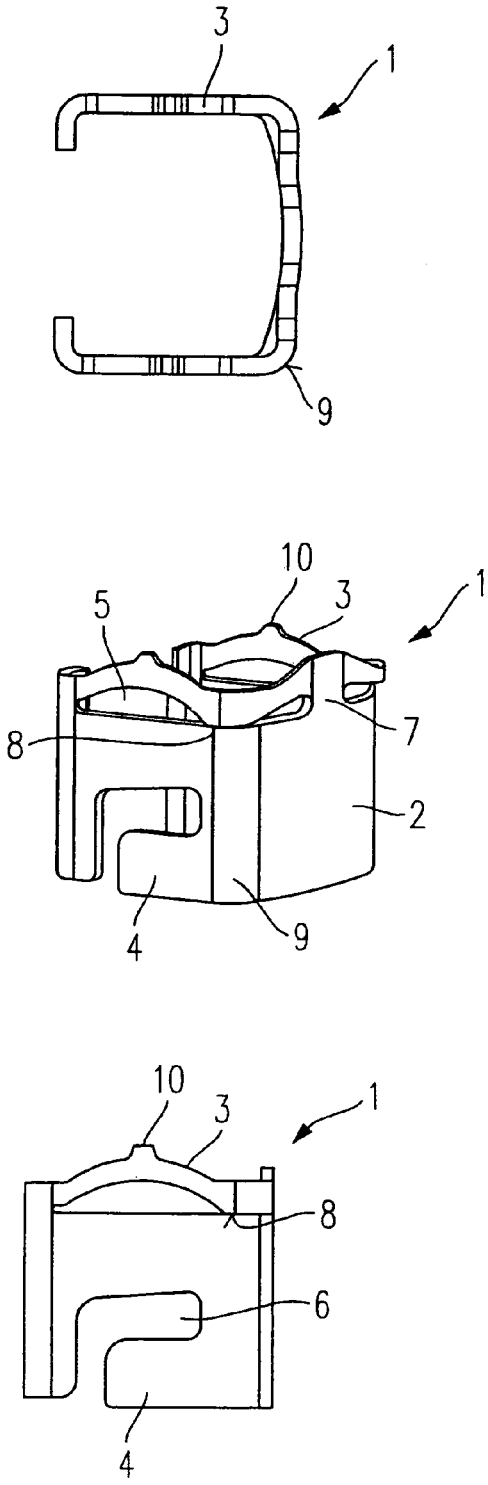
Figure 3A:
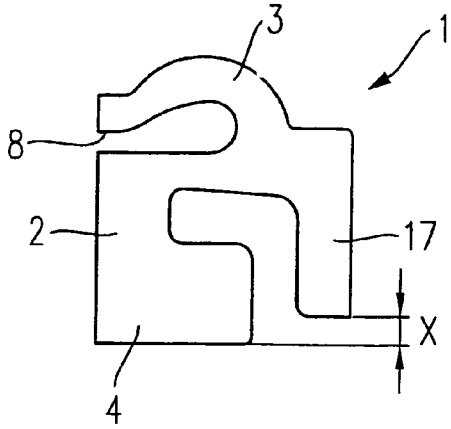
FIGS. 3A–B show a schematic representation of the elastic deformation of a support element developed according to the present invention according to FIG. 2.
Figure 3B:
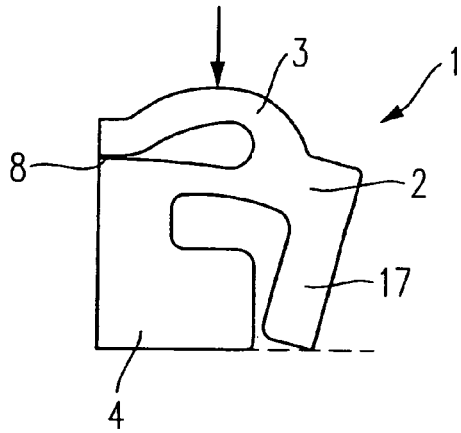

For a better intelligibility of the mode of operation of support element 1, FIGS. 3A and 3B show the non-loaded and a heavily loaded state, in which the compressive forces are so strong that the load exceeds the compressive load represented in FIGS. 1C and 2C. As a consequence, clasp 2 itself is deformed.

As can be seen from FIG. 3A, clasp 2 of support element 1 is in the process deformed in such a way that the axial extension of legs 17 relative to the axial extension of tabs 4 is smaller by an amount X. Accordingly, in the non-loaded state, only tabs 4 abut against the fuel distribution line or the fuel injector, while legs 17 do not rest on a corresponding shoulder of the fuel distribution line or of the fuel injector, but merely effect an axial guidance.

If an axial force now acts on support element 1, first clips 3 as the weakest element are deformed by the load. If the force continues to grow, this is also introduced into clasp 2 of support element 1 with the consequence that clasp 2 is compressed by amount X, by which legs 17 are set apart from the contact surface of the fuel distribution line or the fuel injector. Such a load state may be seen in FIG. 3B. The manifold axial and radial flexibility thus ensures secure bracing for every load state, which prevents damage to the individual components.

Figure 4A:
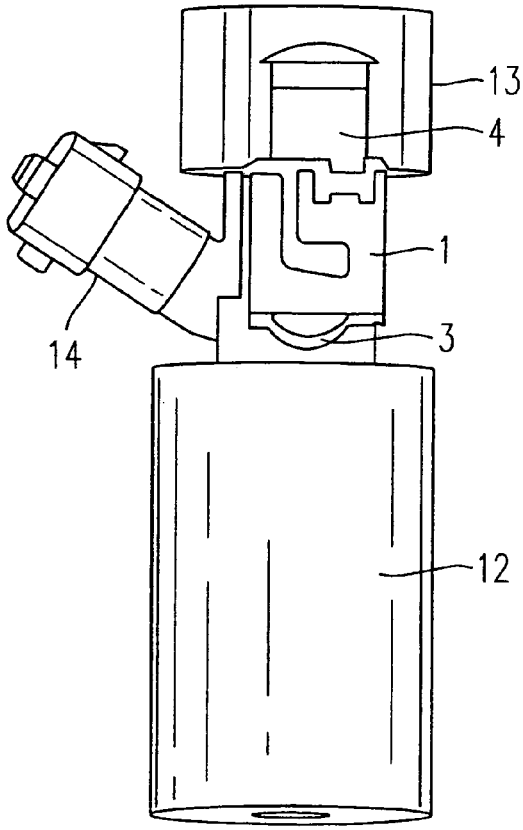
FIGS. 4A–C show a third exemplary embodiment of a support element developed according to the present invention for a fuel injector in various views.
Figure 4B:
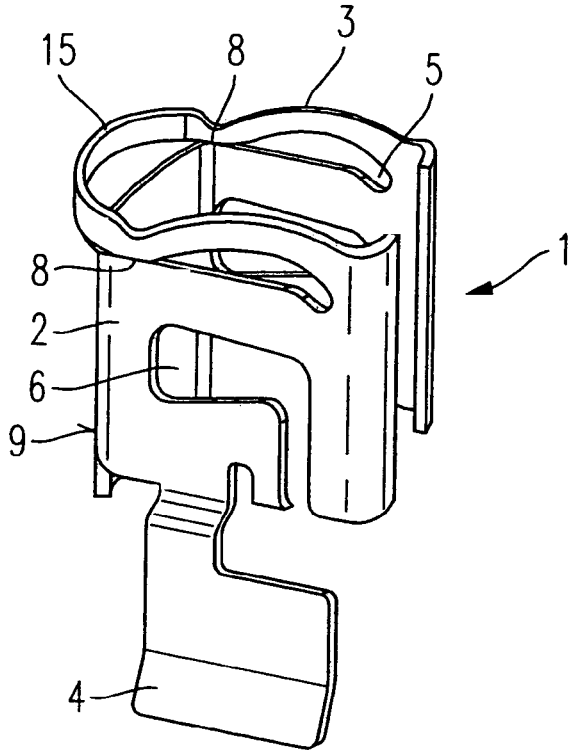
Figure 4C:
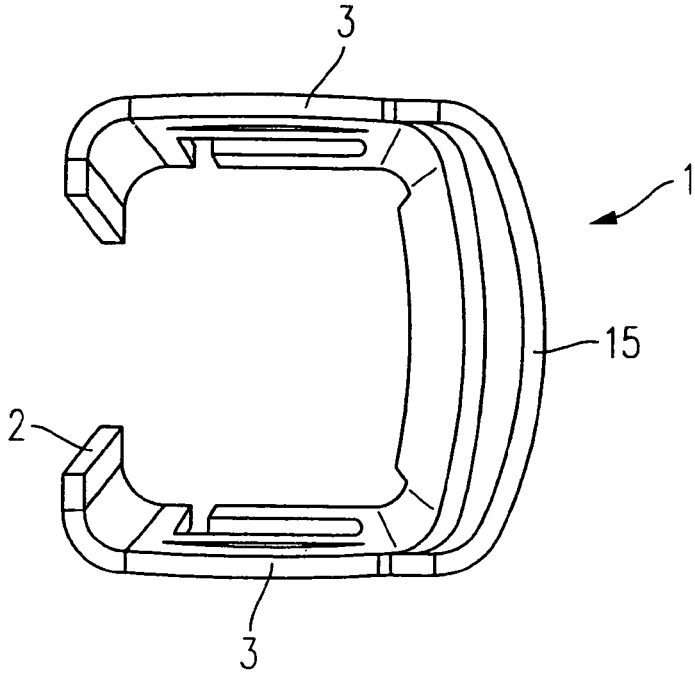

FIGS. 4A through 4C show a third exemplary embodiment of a support element 1 developed according to the present invention in various views. In this exemplary embodiment, as also in the fourth exemplary embodiment represented in FIGS. 5A and 5B, instead of tabs 4 radially embracing the fuel injector, clasp 2 has two axial tabs 4, which are pushed either over the fuel injector or over the fuel distribution line. The clamping effect as well as the supporting effect compensating for the offsets are also ensured by this specific embodiment. All measures for changing the spring characteristic of support element 1 are also applicable in this specific embodiment.

FIG. 4A shows a support element 1 installed between a fuel injector 12 and a fuel distribution line 13, to which a compressive force has not yet been applied. In this exemplary embodiment, clips 3 abut against fuel injector 12, while tabs 4 are engaged at the fuel distribution line.

In this instance, fuel injector 12 may be designed in particular in the form of a direct-injection fuel injector 12, which may be inserted into a valve seat of a cylinder head of the internal combustion engine for the direct injection of fuel into a combustion chamber of a mixture-compressing internal combustion engine (not shown in detail) having externally supplied ignition. The valve seat may also be provided at a connecting piece of an intake manifold (not shown). Fuel injector 12 has an electrical connection 14 for the electrical contacting for actuating fuel injector 12.

As FIG. 4B shows, support element 1 in this exemplary embodiment no longer has a crosspiece 7, which connects the clips according to the above-described exemplary embodiments with clasp 2. Instead, the clips continue in an arch 15, which in the non-loaded state makes contact with clasp 2 across its entire length. This can be seen in outline in FIG. 4A. Arch 15 in this instance is connected exclusively to clips 3, which allows arch 15 to remain free of lateral forces, which would exert an undesirable application of force onto clips 3. This prevents tabs 4 of support element 1 from spreading apart and support element 1 from subsequently sliding down.

If support element 1 has compressive force applied to it by fuel distribution line 13, then again clips 3 as well as arch 15 formed between clips 3 deform in a radial direction such that arch 15 curves outward beyond the outer contour of clasp 2. At the same time, arch 15 is thereby deformed axially in the opposite direction with respect to clips 3, as shown in FIG. 4B, and lifts off of clasp 2. Here too this results in an increased guidance of the support element in the valve seat.

The deformation as well as the outward shifting of arch 15 are also readily seen in the top view onto support element 1 developed according to the present invention, as shown in FIG. 4C.

Figure 5A:
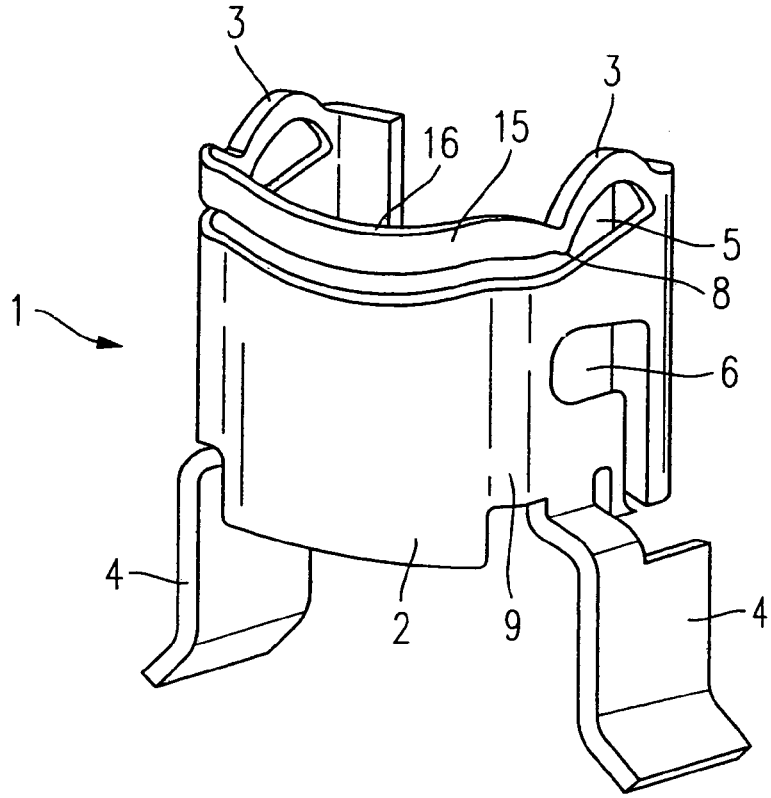
FIGS. 5A–B show a fourth exemplary embodiment of a support element developed according to the present invention for a fuel injector in various views.
Figure 5B:
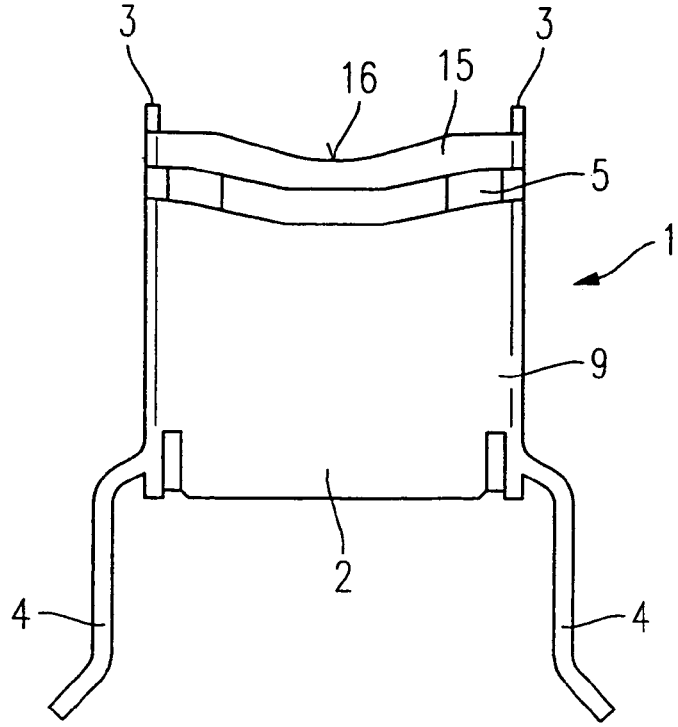

FIGS. 5A and 5B show a fourth exemplary embodiment of a support element 1 developed according to the present invention, which is essentially constructed like the third exemplary embodiment shown in FIGS. 4A through 4C, but which has a cranked arch 15. Approximately at the center between clips 3, arch 15 has a deepening 16, which in the case of more pronounced offsets ensures that fuel injector 12 abutting downstream of clips 3 and arch 15 does not touch down on arch 15 and thus cannot result in lateral forces and thereby in damage to fuel injector 12 and support element 1. To this end, the contour of clasp 2 may be adapted to the contour of arch 15, as seen in FIGS. 5A and 5B.

The present invention is not limited to the exemplary embodiments shown and is for example also applicable to fuel injectors 12 for injection into the combustion chamber of a self-igniting internal combustion engine. In particular, support elements 1 shown in the figures may also be installed in the reverse fitting position such that clips 3 rest on fuel distribution line 13 instead of on fuel injector 12. All features of the present invention may be combined with one another as desired.

What is claimed is:

1. A support element for the mutual bracing of a fuel injector in a valve seat of a cylinder head of an internal combustion engine, and of the fuel injector at a fuel distribution line, comprising:

a clasp and thereon developed radially and axially deformable clips that face one another, wherein recesses are formed between the clips and the clasp, so that in the force-free state of the support element, contact areas of the clips are set apart from the clasp; and a structure having a rectangular cross-sectional form, the recesses extend beyond the corners up to a bent-over region of the clasp that is formed between the clips.

2. The support element as recited in claim 1, wherein in the preformed state of the support element, the contact areas of the clips make contact with the clasp.

3. The support element as recited in claim 2, wherein in the state of the support element in which compressive force is applied, an axial distance between the clips and clasp is smaller as compared to the force-free state.

4. The support element as recited in claim 3, wherein in the state of the support element in which compressive force is applied, the clips are deformed radially outward in a plastic-elastic manner.

5. The support element as recited in claim 4, wherein in the state of the support element in which compressive force is applied, the clips project beyond an outer contour of clasp.

6. The support element as recited in one of claim 1, wherein the clips are tied to the clasp via a crosspiece.

7. The support element as recited in claim 6, wherein the crosspiece is situated approximately at the center between the clips.

8. The support element as recited in claim 1, wherein between the clips an arch is formed.

9. The support element as recited in claim 8, wherein the arch has no connection to the clasp apart from the clips.

10. The support element as recited in claim 9, wherein in the force-free state of the support element, a contact area of the arch is set apart from the clasp.

11. The support element as recited in claim 10, wherein in the preformed state of the support element, the contact area of the arch makes contact with the clasp.

12. The support element as recited in claim 10, wherein in the state of the support element in which compressive force is applied, the arch is deformed in a plastic-elastic manner radially outward and axially counter to the direction of the compressive force.

13. The support element as recited in claim 12, wherein in the state of the support element in which compressive force is applied, the arch projects beyond an outer contour of the clasp.

14. The support element as recited in claim 13, wherein the arch has a cranked design.

15. The support element as recited in claim 14, wherein the arch has a deepening approximately at the center between the clips.

16. The support element as recited in claim 14, wherein the contour of clasp is adapted to the contour of the arch.

17. The support element as recited in claim 16, wherein the number of clips amounts to two.

18. The support element as recited in claim 17, wherein the clasp has additional slots.

19. The support element as recited in claim 18, wherein the clips each have one projection.

20. The support element as recited in claim 19, further comprising:

at least two tabs that embrace the fuel injector or the fuel distribution line or which abut axially against the fuel injector or the fuel distribution line.

21. The support element as recited in claim 20, wherein the support element has legs.

22. The support element as recited in claim 21, wherein the legs in the non-loaded state of the support element are set apart by an amount from the fuel distribution line or the fuel injector.

23. The support element as recited in claim 22, wherein the clasp of the support element is deformable by the amount in a plastic-elastic manner when it is under a load exceeding the load for which the tabs and clips are able to compensate.

24. The support element as recited in claim 23, wherein the clasp is made from spring steel by stamping.

25. The support element as recited in claim 24, wherein the support element has in particular a square cross-sectional form.

26. The support element as recited in claim 25, wherein the fuel injector is braced by the support element against the fuel distribution line.

* * * * *